US012110568B2

(12) United States Patent
Matsui et al.

(10) Patent No.: US 12,110,568 B2
(45) Date of Patent: Oct. 8, 2024

(54) STEEL SHEET AND MEMBER, AND METHODS FOR MANUFACTURING SAME

(71) Applicant: JFE STEEL CORPORATION, Tokyo (JP)

(72) Inventors: Yoichiro Matsui, Tokyo (JP); Yuka Miyamoto, Tokyo (JP); Takeshi Yokota, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 639 days.

(21) Appl. No.: 17/434,255

(22) PCT Filed: Feb. 28, 2020

(86) PCT No.: PCT/JP2020/008223
§ 371 (c)(1),
(2) Date: Aug. 26, 2021

(87) PCT Pub. No.: WO2020/175665
PCT Pub. Date: Sep. 3, 2020

(65) Prior Publication Data

US 2022/0154301 A1 May 19, 2022

(30) Foreign Application Priority Data

Feb. 28, 2019 (JP) ..... 2019-036104

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/54*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/54* (2013.01); *C21D 2211/004* (2013.01); *C21D 2211/005* (2013.01)

(58) Field of Classification Search
None
See application file for complete search history.

(56) References Cited

U.S. PATENT DOCUMENTS

| | | | |
|---|---|---|---|
| 2009/0308504 | A1 | 12/2009 | Kariya et al. |
| 2014/0069556 | A1 | 3/2014 | Kobayashi et al. |
| 2015/0041029 | A1 | 2/2015 | Yamashita et al. |
| 2016/0312325 | A1 | 10/2016 | Hayashi et al. |

FOREIGN PATENT DOCUMENTS

| | | | |
|---|---|---|---|
| EP | 3 020 843 | A1 | 5/2016 |
| JP | 2012-241216 | A | 12/2012 |
| JP | 2015-117406 | A | 6/2015 |
| JP | 2015-146173 | A | 8/2015 |
| KR | 20160018805 | A | 2/2016 |
| WO | 2015/097891 | A1 | 7/2015 |

OTHER PUBLICATIONS

Feb. 6, 2023 Office Action issued in Korean Patent Application No. 10-2021-7026800.
May 26, 2020 International Search Report issued in International Application No. PCT/JP2020/008223.
Nov. 30, 2021 Extended Search Report issued in European Patent Application No. 20762083.2.

*Primary Examiner* — Anthony M Liang
(74) *Attorney, Agent, or Firm* — Oliff PLC

(57) ABSTRACT

A steel sheet and a member excellent in cold workability, hardenability, and post-quenching surface layer hardness, and methods for manufacturing the steel sheet and the member. The steel sheet has a specified chemical composition and a microstructure containing ferrite and carbides, a ratio of the volume of ferrite and carbides to the volume of the entire microstructure is 90% or more, a ratio of the volume of proeutectoid ferrite to the volume of the entire microstructure is 20% or more and 80% or less, a Mn concentration in the carbides is 0.10 mass % or more and 0.50 mass % or less, and a ratio of the number of carbides with particle diameters of 1 μm or more to the total number of carbides is 30% or more and 60% or less.

12 Claims, No Drawings

STEEL SHEET AND MEMBER, AND METHODS FOR MANUFACTURING SAME

TECHNICAL FIELD

This application relates to a steel sheet and a member excellent in cold workability, hardenability, and post-quenching surface layer hardness, and methods for manufacturing the steel sheet and the member.

BACKGROUND

Many machine structural parts such as automotive drive system parts are often manufactured by a method in which a hot rolled steel sheet that is a steel material of carbon steel for machine structure or a steel material of alloy steel for machine structure is cold worked into a product shape and is then subjected to heat treatment in order to ensure a desired hardness.

Hence, excellent cold workability, hardenability, and post-quenching surface layer hardness are required of the hot rolled steel sheet serving as the raw material, and various steel sheets have been proposed until now.

For example, Patent Literature 1 describes a high carbon hot rolled steel sheet that has a composition containing, in mass %, C: 0.20 to 0.40%, Si: 0.10% or less, Mn: 0.50% or less, P: 0.03% or less, S: 0.010% or less, sol. Al: 0.10% or less, N: 0.005% or less, and B: 0.0005 to 0.0050%, further containing one or more of Sb, Sn, Bi, Ge, Te, and Se: 0.002 to 0.03% in total, with the balance being Fe and incidental impurities, and that has a microstructure in which the ratio of the amount of solute B in the B content is 70% or more, ferrite and carbides are contained, and the carbide density in the ferrite grain is $0.08/\mu m^2$ or less, and in which the hardness is 73 or less in terms of HRB and the total elongation is 39% or more.

Further, Patent Literature 2 proposes a high carbon hot rolled steel sheet excellent in blanking property, the steel sheet containing, in mass %, C: 0.10 to 0.70%, Si: 0.01 to 1.0%, Mn: 0.1 to 3.0%, P: 0.001 to 0.025%, S: 0.0001 to 0.010%, Al: 0.001 to 0.10%, and N: 0.001 to 0.010%, the steel sheet further containing one or two or more of Ti: 0.01 to 0.20%, Cr: 0.01 to 1.50%, Mo: 0.01 to 0.50%, B: 0.0001 to 0.010%, Nb: 0.001 to 0.10%, V: 0.001 to 0.2%, Cu: 0.001 to 0.4%, W: 0.001 to 0.5%, Ta: 0.001 to 0.5%, Ni: 0.001 to 0.5%, Mg: 0.001 to 0.03%, Ca: 0.001 to 0.03%, Y: 0.001 to 0.03%, Zr: 0.001 to 0.03%, La: 0.001 to 0.03%, and Ce: 0.001 to 0.030%, with the balance being Fe and impurities, and the steel sheet in which the degree of accumulation of crystal orientations in each of which the (110) plane has a degree of parallelism of within ±5° with respect to the surface of the steel sheet is 2.5 or more, in a region extending to 200 μm in the sheet thickness direction from the surface layer of the steel sheet.

CITATION LIST

Patent Literature

Patent Literature 1: JP 2015-146173 A1
Patent Literature 2: JP 2015-117406 A

SUMMARY

Technical Problem

In the technology described in Patent Literature 1, one or more of Ni, Cr, and Mo, which are alloying elements that enhance hardenability, are contained only at 0.50 mass % or less in total in steel having a carbon content of 0.20 to 0.40 mass %; thus, this technology is unsuitable for automotive parts or the like that have larger sheet thicknesses and that require thorough quenching up to the central portion.

In Patent Literature 2, the degree of accumulation of crystal orientations in each of which the (110) plane of the body-centered cubic lattice of iron has a degree of parallelism of within ±5° with respect to the surface of the steel sheet is controlled to 2.5 or more, and thereby blanking property is enhanced. However, there is no description regarding hardness after quenching or post-quenching surface layer hardness.

An object of the disclosed embodiments is to provide a steel sheet and a member that solve the problem mentioned above and that are excellent in cold workability, hardenability, and post-quenching surface layer hardness, and methods for manufacturing the steel sheet and the member.

Solution to Problem

The inventors conducted extensive studies, and have for the first time obtained the findings that a steel sheet excellent in cold workability, hardenability, and post-quenching surface layer hardness is obtained by setting a steel sheet in such a manner that it has a predetermined chemical composition and that ferrite and carbides in the microstructure satisfy predetermined relationships. The disclosed embodiments have been made on the basis of such findings, and the gist of the disclosed embodiments is as follows.

[1] A steel sheet including: a chemical composition containing, in mass %,
C: 0.10% or more and 0.33% or less,
Si: 0.01% or more and 0.50% or less,
Mn: 0.40% or more and 1.25% or less,
P: 0.03% or less,
S: 0.01% or less,
sol. Al: 0.10% or less,
N: 0.01% or less,
Cr: 0.50% or more and 1.50% or less, with the balance being Fe and incidental impurities; and a microstructure containing ferrite and carbides,
in which a ratio of a volume of the ferrite and the carbides to a volume of an entire microstructure is 90% or more, and a ratio of a volume of proeutectoid ferrite to the volume of the entire microstructure is 20% or more and 80% or less, and
a Mn concentration in the carbides is 0.10 mass % or more and 0.50 mass % or less, and a ratio of a number of carbides with particle diameters of 1 μm or more to a total number of carbides is 30% or more and 60% or less.

[2] The steel sheet according to [1], in which the chemical composition further contains, in mass %, B: 0% or more and 0.01% or less.

[3] The steel sheet according to [1] or [2], in which the chemical composition further contains, in mass %, one or more of Sb, Sn, Bi, Ge, Te, and Se: 0.002% or more and 0.03% or less in total.

[4] The steel sheet according to any one of [1] to [3], in which the chemical composition further contains, in mass %, one or more of Ni and Mo: 0.01% or more and 0.5% or less in total.

[5] The steel sheet according to any one of [1] to [4], in which the chemical composition further contains, in mass %, one or more of Nb, Ti, and V: 0.001% or more and 0.05% or less in total.

[6] A method for manufacturing a steel sheet, the method including:

performing rough hot rolling on a steel raw material having the chemical composition according to any one of [1] to [5], subsequently performing finish rolling at a finishing temperature of 920° C. or less, and performing cooling such that an average cooling rate from the finishing temperature to 700° C. is 50° C./s or less, subsequently performing coiling at a coiling temperature of 550° C. or more and 700° C. or less and causing a ratio of a volume of proeutectoid ferrite grains with grain diameters of 3 μm or more to a volume of an entire microstructure to be 20% or more and 80% or less, and subsequently performing annealing at an annealing temperature of 700° C. or more and less than an $Ac_1$ transformation temperature.

[7] A method for manufacturing a steel sheet, the method including:

performing rough hot rolling on a steel raw material having the chemical composition according to any one of [1] to [5], subsequently performing finish rolling at a finishing temperature of 920° C. or less, and performing cooling such that an average cooling rate from the finishing temperature to 700° C. is 50° C./s or less, subsequently performing coiling at a coiling temperature of 550° C. or more and 700° C. or less and causing a ratio of a volume of proeutectoid ferrite grains with grain diameters of 3 μm or more to a volume of an entire microstructure to be 20% or more and 80% or less, and subsequently performing annealing by performing heating to a temperature of an $Ac_1$ transformation temperature or more and 800° C. or less, performing holding for 0.5 hours or more, subsequently performing cooling to less than an $Ar_1$ transformation temperature, and performing holding at 700° C. or more and less than the $Ar_1$ transformation temperature for 20 hours or more.

[8] A member obtained by performing at least one of forming and heat treatment on the steel sheet according to any one of [1] to [5].

[9] A method for manufacturing a member, the method including: a step of performing at least one of forming and heat treatment on a steel sheet manufactured by the method for manufacturing a steel sheet according to [6] or [7].

Advantageous Effects

According to the disclosed embodiments, a steel sheet and a member excellent in cold workability, hardenability, and post-quenching surface layer hardness, and methods for manufacturing the steel sheet and the member can be provided. Since the steel sheet of the disclosed embodiments is excellent in cold workability, hardenability, and post-quenching surface layer hardness, the steel sheet of the disclosed embodiments can be suitably used for automotive parts such as gears, transmissions, and seat recliners, of which the raw material steel sheet is required to have cold workability and quenching hardness after heat treatment.

DETAILED DESCRIPTION

Hereinbelow, a steel sheet of the disclosed embodiments and a method for manufacturing the same are described in detail.

A description will now be given in the order of the chemical composition, the microstructure, and the manufacturing conditions of the steel sheet. Here, when the content of the chemical composition is expressed in units of %, "%" refers to "mass %", unless otherwise noted.

1) Chemical Composition

C: 0.10% or More and 0.33% or Less

C is an element important for obtaining the strength after quenching. If the C content is less than 0.10%, a desired hardness is not obtained by heat treatment after forming to the component shape; thus, the C content is set to 0.10% or more. The C content is preferably set to 0.18% or more from the viewpoint of obtaining a larger Vickers hardness (HV) after heat treatment at a position of ¼ of the sheet thickness (¼ t). On the other hand, if the C content is more than 0.33%, hardness is increased, and toughness and cold workability are degraded. Thus, the C content is set to 0.33% or less. In the case of use for a part that requires severe plastic deformation, the C content is preferably set to 0.28% or less from the viewpoint of ensuring cold workability.

Si: 0.01% or More and 0.50% or Less

Si is an element that has the effect of suppressing softening associated with tempering and that raises strength by solid solution strengthening. As the Si content increases, hardness increases and cold workability degrades; thus, the Si content is 0.50% or less, and preferably 0.33% or less. On the other hand, if the Si content is excessively reduced, the Si's effect of suppressing temper softening is difficult to obtain; thus, the Si content is 0.01% or more, and preferably 0.15% or more.

Mn: 0.40% or More and 1.25% or Less

Mn is an element to enhance strength on the basis of solid solution strengthening in addition to enhancing the hardenability. If the Mn content is more than 1.25%, a band structure caused by the segregation of Mn develops and the microstructure becomes non-uniform, and therefore cold workability is reduced. Thus, the Mn content is 1.25% or less, and preferably 1.00% or less. On the other hand, if the Mn content is less than 0.40%, hardenability starts to decrease; thus, the Mn content is 0.40% or more, and preferably 0.50% or more.

P: 0.03% or Less

P is an element that reduces cold workability and toughness after quenching; if the P content is increased to more than 0.03%, grain boundary embrittlement is caused, and toughness after quenching is degraded. Therefore, the P content is set to be 0.03% or less. It is preferable that the P content be 0.02% or less in order to achieve excellent toughness after quenching has been performed. It is preferable that the P content be as small as possible, however, since there is an increase in refining costs in the case where the P content is excessively low, it is preferable that the P content be 0.002% or more.

S: 0.01% or Less

If the S content is more than 0.01%, sulfides are formed, and the cold workability and the toughness after quenching of the steel sheet are considerably degraded. Therefore, the S content is set to be 0.01% or less. It is preferable that the S content be 0.005% or less in order to achieve excellent cold workability and toughness after quenching has been performed. It is preferable that the S content be as small as possible, however, since there is an increase in refining costs in the case where the S is excessively low, it is preferable that the S content be 0.0002% or more.

Sol. Al: 0.10% or Less

In the case where the sol. Al content is more than 0.10%, since the austenite grain is refined due to the formation of AlN when heating is performed for a quenching treatment, the microstructure becomes ferrite and martensite because the formation of a ferrite phase is promoted when cooling is performed, thus results in a decrease in hardness after quenching has been performed. Thus, the sol. Al content is set to 0.10% or less, and preferably 0.06% or less. Al forms alumina-based inclusions in molten steel, and is a factor in nozzle clogging during casting; thus, the sol. Al content is preferably as small as possible; the lower limit is not particularly prescribed, but the sol. Al content is preferably 0.001% or more from the viewpoint of increase in refining cost.

N: 0.01% or Less

In the case where the N content is more than 0.01%, since the austenite grain is refined due to the formation of AlN when heating is performed for a quenching treatment, the formation of a ferrite phase is promoted when cooling is performed, which results in a decrease in hardness after quenching has been performed. Thus, the N content is 0.01% or less, and preferably 0.0050% or less. Note that there is no particular limitation on the lower limit of the N, however, N is a chemical element which increases toughness after quenching has been performed by appropriately inhibiting austenite grain growth when heating is performed for a quenching treatment as a result of forming AlN, Cr-based nitride, and Mo-based nitride, it is preferable that the N content be 0.0005% or more.

Cr: 0.50% or More and 1.50% or Less

Cr is an important element that enhances hardenability; if the Cr content is less than 0.50%, a sufficient effect is not obtained; thus, the Cr content is 0.50% or more, and preferably 0.70% or more. On the other hand, if Cr content is more than 1.50%, the steel sheet before quenching is increased in hardness, and cold workability is impaired; thus, the Cr content is set to 1.50% or less. When working a part that requires severe plastic deformation in which press forming is difficult, even more excellent cold workability is required; thus, the Cr content is preferably 1.25% or less, and more preferably 1.20% or less.

The components mentioned above are essential components of the disclosed embodiments. In the disclosed embodiments, the following elements may be contained as necessary.

B: 0% or More and 0.01% or Less

B is an important element that enhances hardenability, and is preferably added at 0.01% or less. If the B content is more than 0.01%, the recrystallization of austenite after finish rolling is delayed. As a result, rolling texture of the hot rolled steel sheet develops, and the in-plane anisotropy of mechanical property values of the steel sheet after annealing is increased. Consequently, an earing is likely to occur in draw forming, circularity is reduced, and thus a defect is likely to occur during forming. Thus, in the case where B is contained, the B content is preferably set to 0.01% or less. Even when B accounts for 0%, the effects of the disclosed embodiments are obtained; thus, B may account for 0%. However, under the condition of the cooling rate after finish rolling in hot rolling of the disclosed embodiments, if the B content is less than 0.0005%, the content of solute B, which delays ferrite transformation, may be insufficient, and a sufficient effect of hardenability improvement by B may not be obtained. Thus, in the case where B is contained, the B content is preferably set to 0.0005% or more, and is more preferably 0.0010% or more.

One or More of Sb, Sn, Bi, Ge, Te, and Se: 0.002% or More and 0.03% or Less in Total Each of Sb, Sn, Bi, Ge, Te, and Se is an important element to suppress nitriding from the surface layer. If the total content of one or more of these elements is less than 0.002%, a sufficient effect is not obtained. Thus, in the case where one or more of these elements are contained, the content is preferably set to 0.002% or more in total, and more preferably set to 0.005% or more in total. On the other hand, even if these elements are contained at more than 0.03% in total, the nitriding prevention effect is saturated. Further, these elements tend to segregate at grain boundaries; if the content of these elements is set to more than 0.03% in total, the content is too large, and grain boundary embrittlement may be caused. Thus, the total content of one or more of Sb, Sn, Bi, Ge, Te, and Se is preferably set to 0.03% or less, and more preferably set to 0.02% or less. Further, since nitriding can thus be suppressed, there is an effect of, in the case where B is contained in the steel sheet, suppressing a situation where solute B, which contributes to hardenability improvement, forms a nitride as BN.

One or More of Ni and Mo: 0.01% or More and 0.5% or Less in Total

Each of Ni and Mo is an important element that enhances hardenability, and improves hardenability in the case where the containing of Cr alone does not satisfy a required hardenability. Further, each of Ni and Mo has the effect of suppressing temper softening resistance. To obtain such effects, in the case where one or more of Ni and Mo are contained, the total content is preferably set to 0.01% or more, and more preferably set to 0.1% or more. On the other hand, if one or more of Ni and Mo are contained at more than 0.5% in total, the steel sheet before quenching may be increased in hardness, and cold workability may be impaired; thus, in the case where one or more of Ni and Mo are contained, the content is preferably set to 0.5% or less in total. When working for a part that requires severe plastic deformation in which press forming is difficult, even more excellent cold workability is required; thus, the content is more preferably 0.3% or less in total.

One or More of Nb, Ti, and V: 0.001% or More and 0.05% or Less in Total

Each of Nb, Ti, and V forms nitrides together with N and thereby contributes to an improvement in wear resistance, and has the effect of, in the case where B is contained in the steel sheet, suppressing a situation where solute B, which contributes to hardenability improvement, forms a nitride as BN. To obtain such effects, in the case where one or more of Nb, Ti, and V are contained, the content is preferably set to 0.001% or more in total. On the other hand, if one or more of Nb, Ti, and V are contained at more than 0.05% in total, precipitates such as carbides may be formed, and the steel sheet before quenching may be increased in hardness and cold workability may be impaired; thus, the content is preferably set to 0.05% or less in total, and more preferably set to 0.03% or less in total.

The balance other than the components mentioned above includes Fe and incidental impurities. In the case where any of the arbitrary components mentioned above is contained at less than the lower limit in the chemical composition, it is assumed that the arbitrary component contained at less than the lower limit is included in the incidental impurities. As incidental impurities, O: 0.005% or less and Mg: 0.003% or less are permissible. As a component that does not impair the effects of the disclosed embodiments, Cu: 0.04% or less may be contained.

2) Microstructure

The steel sheet of the disclosed embodiments has a microstructure containing ferrite and carbides.

Ratio of the Volume of Ferrite and Carbides to the Volume of the Entire Microstructure being 90% or More In the case where balance microstructures such as bainite, martensite, and pearlite are contained in addition to ferrite and carbides, cold workability and blanking property are impaired; thus, the ratio of the volume of ferrite and carbides is 90% or more, preferably 95% or more, relative to the volume of the entire microstructure.

Ratio of the Volume of Proeutectoid Ferrite to the Volume of the Entire Microstructure being 20% or More and 80% or Less The proeutectoid ferrite referred to in the disclosed embodiments refers to ferrite in which the ratio of the volume of carbides in the crystal grain is less than 5%. The proeutectoid ferrite is ferrite that is precipitated as a primary crystal in the cooling process after hot rolling and that contains practically almost no carbides, and contributes to an improvement in the cold workability of the steel sheet. To obtain such an effect sufficiently, the ratio of the volume of proeutectoid ferrite in the entire structure is 20% or more, and preferably 25% or more. If the ratio of the volume of proeutectoid ferrite in the entire microstructure is more than 80%, second phases such as pearlite and bainite are formed in the microstructure after hot rolling, and the distribution of carbides after annealing becomes non-uniform and the hardness distribution after quenching becomes non-uniform. Thus, the ratio of the volume of proeutectoid ferrite in the entire microstructure is 80% or less, and preferably 60% or less.

Mn Concentration in the Carbides being 0.10 Mass % or More and 0.50 Mass % or Less, and Furthermore the Ratio of the Number of Carbides with Particle Diameters of 1 μm or More to the Total Number of Carbides being 30% or More and 60% or Less The "Mn concentration in the carbides" referred to in the disclosed embodiments is the average concentration of Mn in the carbides, and can be measured by, for example, a method described in Examples. The Mn concentration in the carbides and the particle diameter of the carbides have a correlation with the surface layer hardness after quenching. In the case where Mn is concentrated in the carbides and furthermore the particle diameter of the carbides is sufficiently large, the carbides are less likely to dissolve during heating of heat treatment after forming into part, and thereby some undissolved carbides are likely to occur; by virtue of the fact that undissolved carbides exist in the surface layer of the steel sheet, the surface layer hardness after quenching is improved. To obtain such an effect, the Mn concentration in the carbides is set to 0.10 mass % or more, and furthermore the ratio of the number of carbides with particle diameters of 1 μm or more to the total number of carbides is set to 30% or more. The Mn concentration in the carbides is preferably 0.15 mass % or more. Further, the ratio of the number of carbides with particle diameters of 1 μm or more to the total number of carbides is preferably 35% or more. On the other hand, if the Mn concentration in the carbides and the particle diameter of the carbides are too large, the amount of undissolved carbides occurring during heat treatment is excessively large, and sufficient quenching hardness is not obtained; thus, the Mn concentration in the carbides is set to 0.50 mass % or less, and the ratio of the number of carbides with particle diameters of 1 μm or more to the total number of carbides is set to 60% or less. The Mn concentration in the carbides is preferably 0.30 mass % or less. Further, the ratio of the number of carbides with particle diameters of 1 μm or more to the total number of carbides is preferably 50% or less, and more preferably 40% or less.

3) Manufacturing Condition

A steel sheet according to the disclosed embodiments is manufactured by performing rough hot rolling on a steel raw material having the chemical composition described above, subsequently performing finish rolling at a finishing temperature of 920° C. or less, and performing cooling such that an average cooling rate from the finishing temperature to 700° C. is 50° C./s or less, subsequently performing coiling at a coiling temperature of 550° C. or more and 700° C. or less and causing a ratio of a volume of proeutectoid ferrite grains with grain diameters of 3 μm or more to a volume of an entire microstructure to be 20% or more and 80% or less, and subsequently performing annealing.

The annealing can be performed by the following (1) or (2).

(1) Annealing at an annealing temperature of 700° C. or more and less than an $Ac_1$ transformation temperature.

(2) Performing annealing by performing heating to a temperature of an $Ac_1$ transformation temperature or more and 800° C. or less, performing holding for 0.5 hours or more, subsequently performing cooling to less than an $Ar_1$ transformation temperature, and performing holding at 700° C. or more and less than the $Ar_1$ transformation temperature for 20 hours or more.

The sheet thickness of the steel sheet of the disclosed embodiments is not particularly limited, but is preferably set to 1.0 mm or more and 20 mm or less.

Reasons for limiting the conditions in the method for manufacturing a steel sheet of the disclosed embodiments will now be described. The temperature shown in the manufacturing method means the surface temperature of the steel raw material, the steel sheet, or the like.

In the disclosed embodiments, the method for manufacturing the steel raw material does not need to be particularly limited.

For the melting and refining of the steel of the disclosed embodiments, either a converter or an electric furnace may be used. The steel thus melted and refined is made into a slab by ingot casting-blooming or continuous casting. The slab is usually heated and then hot rolled (rough hot rolling and finish rolling). In the case where the slab is heated and hot rolled, the slab reheating temperature is preferably set to 1280° C. or less in order to avoid a degradation in surface condition due to scale. Since finish rolling is performed at a predetermined temperature in hot rolling, the material to be rolled may be heated by a heating means such as a sheet bar heater during hot rolling.

Finish Rolling at a Finishing Temperature of 920° C. or Less

By setting the finishing temperature to 920° C. or less, strain is introduced into austenite and ferrite transformation is accelerated, and proeutectoid ferrite, which contributes to cold workability improvement, can be obtained. Thus, the finishing temperature is 920° C. or less, and preferably 915° C. or less. The lower limit is not particularly prescribed, but the finishing temperature is preferably 800° C. or more from the viewpoint of reduction in rolling load during rough rolling. The finishing temperature is the surface temperature of the steel sheet.

Cooling from the Finishing Temperature to 700° C. at an Average Cooling Rate of 50° C./s or Less The temperature from the finishing temperature to 700° C. or more is a temperature range in which Mn can easily diffuse; by performing cooling gradually through this temperature range, Mn and Cr can be concentrated in the carbides. If the average cooling rate in this temperature range is more than 50° C./s, the effect mentioned above becomes insufficient; thus, the average cooling rate is 50° C./s or less. The average cooling rate is preferably 40° C./s or less. The lower limit of the average cooling rate is not particularly limited, but is preferably 20° C./s or more from the viewpoint of suppressing excessive diffusion of Mn to the carbides.

Coiling Temperature: 550° C. or More and 700° C. or Less

The hot rolled steel sheet after finish rolling is coiled in a coil shape. If the coiling temperature is too high, the strength of the hot rolled steel sheet becomes too low, and thus the hot rolled steel sheet, when coiled in a coil shape, may deform because of the coil's own weight; hence, this is not preferable in terms of operation. Thus, the coiling temperature is 700° C. or less, and preferably 680° C. or less. On the other hand, if the coiling temperature is too low, a sufficient amount of proeutectoid ferrite is not obtained, and the hot rolled steel sheet increases in hardness; hence, this is not preferable. Thus, the coiling temperature is 550° C. or more, and is preferably set to 580° C. or more. In the case where the coiling temperature is set in the temperature range of 580° C. or more and 680° C. or less, the average cooling rate from 700° C. to the coiling temperature is preferably set to 40° C./s or less in order to obtain proeutectoid ferrite stably. The coiling temperature is the surface temperature of the steel sheet.

Ratio of the Volume of Proeutectoid Ferrite Grains with Grain Diameters of 3 μm or More to the Volume of the Entire Microstructure being Set to 20% or More and 80% or Less By containing proeutectoid ferrite in the microstructure of the steel sheet after hot rolling, ferrite containing substantially no carbides within the grain can be introduced into the microstructure of the steel sheet after annealing. The larger the grain diameter of the proeutectoid ferrite is, the more excellent the steel sheet is in cold workability. Thus, the ratio of the volume of proeutectoid ferrite grains with grain diameters of 3 μm or more to the volume of the entire microstructure of the steel sheet after hot rolling is 20% or more, and preferably 25% or more. If the ratio of the volume of proeutectoid ferrite grains with grain diameters of 3 μm or more to the volume of the entire microstructure is more than 80%, second phases such as pearlite and bainite are formed in the microstructure after hot rolling, and the distribution of carbides after annealing becomes non-uniform and the hardness distribution after quenching becomes non-uniform. Thus, the ratio of the volume of proeutectoid ferrite grains with grain diameters of 3 μm or more to the volume of the entire microstructure is 80% or less, and preferably 60% or less. By implementation in such a manner that both of the conditions of the finishing temperature and the coiling temperature described above are satisfied, the ratio of the volume of proeutectoid ferrite grains with grain diameters of 3 μm or more to the volume of the entire microstructure can be adjusted to within the range of the disclosed embodiments mentioned above.

In the method for manufacturing a hot rolled steel sheet of the disclosed embodiments, annealing is performed under annealing condition (1) or (2) below.

Annealing Condition (1): Annealing at an Annealing Temperature of 700° C. or More and Less than an $Ac_1$ Transformation Temperature The hot rolled steel sheet obtained in the above manner is subjected to annealing (annealing for carbide spheroidization). If the annealing temperature is the Act transformation temperature or more, austenite is formed and a coarse pearlite structure is formed in the cooling process after annealing, and a non-uniform structure is produced. Thus, the annealing temperature is set to less than the Ac-transformation temperature. In order for the number density of carbide particles in the ferrite grain to be set to a desired value, the annealing temperature is set to 700° C. or more, and preferably 710° C. or more. As the atmosphere gas, any of nitrogen, hydrogen, and mixed gas of nitrogen and hydrogen may be used, and these gases are preferably used; however, also Ar may be used, and the atmosphere gas is not particularly limited. The annealing time is preferably set to 0.5 to 40 hours. In order that a target microstructure can be obtained stably and the hardness of the steel sheet can be set to a predetermined value or less, the annealing time is preferably set to 0.5 hours or more, and more preferably set to 8 hours or more. If the annealing time is more than 40 hours, productivity is reduced, and the manufacturing cost is likely to be too high; thus, the annealing time is preferably set to 40 hours or less, and more preferably set to 35 hours or less. The annealing temperature is defined as the surface temperature of the steel sheet. The annealing time is defined as the time during which a predetermined temperature is maintained.

Annealing Condition (2): Performing Heating to a Temperature of an $A_1$, Transformation Temperature or More and 800° C. or Less, Performing Holding for 0.5 Hours or More, Subsequently Performing Cooling to Less than an $Ar_1$ Transformation Temperature, and Performing Holding at 700° C. or More and Less than the $Ar_1$ Transformation Temperature for 20 Hours or More The hot rolled steel sheet mentioned above is heated to a temperature of the $Ac_1$ transformation temperature or more and 800° C. or less, and is held for 0.5 hours or more; thereby, relatively fine carbides that have been precipitated in the hot rolled steel sheet are dissolved, and austenite with a large amount of solute C is partially formed. On the other hand, ferrite not transformed to austenite and remained is annealed at high temperature, and therefore the dislocation density is reduced and softness is increased. Further, relatively coarse carbides not dissolved (undissolved carbides) remain in the ferrite, and these carbides become coarser by Ostwald ripening. If the annealing temperature is less than the $Ac_1$ transformation temperature, austenite transformation does not occur, and therefore carbides cannot be made dissolved as solid solution in austenite. Thus, the annealing temperature is the $Ac_1$ transformation temperature or more, and preferably (the $Ac_1$ transformation temperature+10° C.) or more. If the annealing temperature is more than 800° C., austenite is formed coarsely; hence, in the subsequent cooling process, spheroidization does not occur in the austenite region and pearlite is formed; consequently, cold workability is reduced. Thus, the annealing temperature is 800° C. or less, and preferably 760° C. or less. Further, if the hold time at a temperature of the $Ac_1$ transformation temperature or more and 800° C. or less is less than 0.5 hours, fine carbides cannot be made dissolved sufficiently. Thus, heating is performed to a temperature of the $Ac_1$ transformation temperature or more and 800° C. or less and holding is performed for 0.5 hours or more, and it is preferable to perform holding for 1 hour or more.

After that, cooling is performed to less than the $Ar_1$ transformation temperature, and holding is performed at 700° C. or more and less than the $Ar_1$ transformation temperature for 20 hours or more; thereby, relatively coarse carbides are precipitated, with austenite or the austenite/ferrite interface as a nucleus, and a microstructure in which the spheroidization rate of carbides is high can be obtained; in addition, coarse spheroidal carbides are further grown by Ostwald ripening, and the number of fine carbides, which cause deteriorations in cold workability and/or blanking property, can be reduced. If the annealing temperature is less than 700° C., the growth of carbides becomes insufficient. Thus, the annealing temperature is 700° C. or more, and preferably 710° C. or more. If the annealing temperature is the $Ar_1$ transformation temperature or more, austenite grows coarsely, and pearlite, which is a cause of a deterioration in workability, is formed during cooling. Thus, the annealing temperature is less than the $Ar_1$ transformation temperature. Further, if the hold time at a temperature of 700° C. or more and less than the $Ar_1$ transformation temperature is less than 20 hours, carbides cannot be grown sufficiently, and cold workability is reduced. Thus, cooling is performed to less than the $Ar_1$ transformation temperature, and holding is performed at 700° C. or more and less than the $Ar_1$ transformation temperature for 20 hours or more. The hold time is preferably 25 hours or more.

As the atmosphere gas, any of nitrogen, hydrogen, and mixed gas of nitrogen and hydrogen may be used, and these gases are preferably used; however, also Ar may be used, and the atmosphere gas is not particularly limited.

A member according to the disclosed embodiments is a member obtained by performing at least one of forming and heat treatment on the steel sheet according to the disclosed embodiments. A method for manufacturing a member according to the disclosed embodiments includes a step of performing at least one of forming and heat treatment on a steel sheet manufactured by the method for manufacturing a steel sheet according to the disclosed embodiments.

The steel sheet of the disclosed embodiments is excellent in cold workability, blanking property, and hardenability. Further, a member obtained by using the steel sheet of the disclosed embodiments is excellent in the hardness of the surface layer of the steel sheet after quenching, and is therefore excellent in wear resistance. Further, in the case where blanking is performed when manufacturing a member, the tool (die) used at the time of blanking can have a longer life. The member of the disclosed embodiments can be suitably used for, for example, automotive parts such as gears, transmissions, and seat recliners.

The forming may use common working methods without limitations, such as press working and blanking. Further, the heat treatment may use common heat treatment methods without limitations, such as induction quenching, carburizing and quenching, quenching, and tempering used for a steel material of carbon steel for machine structure or a steel material of alloy steel for machine structure.

EXAMPLES

The disclosed embodiments will now be specifically described with reference to Examples. Note that the scope of the embodiments is not intended to be limited to the following specific Examples.

Steel raw materials having the chemical compositions shown in Table 1 were melted and refined. Next, these steel raw materials were hot rolled under the hot rolling conditions shown in Table 2-1, and hot rolled steel sheets were produced. In the case where the coiling temperature was less than 700° C., cooling was performed from the finishing temperature to 700° C., and then the average cooling rate from 700° C. to the coiling temperature was set within the range of more than 0 to 40° C./s. Next, surface scale formed during hot rolling was removed, annealing under the conditions shown in Table 2-1 (spheroidization annealing) was performed in a nitrogen atmosphere, and hot rolled-annealed sheets each with a sheet thickness of 3.0 mm were manufactured as steel sheets of the disclosed embodiments. For the hot rolled-annealed sheet thus manufactured, the microstructure, cold workability, hardenability, and the Mn concentration in the carbides were investigated by the methods shown below. The results are shown in Table 3. In the annealing conditions of No. 9 of Table 2-1, "750° C.·1 hr→715° C.·20 hr" means that holding was performed at 750° C. for 1 hour, then cooling was performed to 715° C., holding was performed at 715° C. for 20 hours, and annealing was thus performed. Further, in the annealing conditions of No. 10 of Table 2-1, "810° C.·1 hr→715° C.·20 hr" means that holding was performed at 810° C. for 1 hour, then cooling was performed to 715° C., holding was performed at 715° C. for 20 hours, and annealing was thus performed. Similarly, also for Nos. 20, 21, and 24 to 26 of Table 2-1, annealing was performed in two steps using the respective holding temperatures and hold times described in Table 2-1.

The Ac; transformation temperature and the $Ar_1$ transformation temperature shown in Table 1 were obtained in the following manner. Using a cylindrical test piece (diameter: 3 mm×height: 10 mm) in a Formastor testing machine, an dilation curve during heating was measured, and the temperature at which transformation was started from ferrite to austenite (the $Ac_1$ transformation temperature) was obtained. Further, using a similar test piece, an expansion curve when heating was performed to the austenite single-phase region and then cooling was performed from the austenite single-phase region to room temperature was measured, and the temperature at which transformation from austenite to ferrite and carbides was completed (the $Ar_1$ transformation temperature) was obtained.

Microstructure

A sample was taken by cutting from a sheet-width central portion of each of the hot rolled steel sheets and the hot rolled-annealed sheets mentioned above; each sample was polished and was then subjected to nital etching, and the microstructure of a cross section in the rolling direction was observed by using a scanning electron microscope. For the hot rolled steel sheet, image analysis processing described below was performed on a scanning electron microscope photograph to determine the volume fraction of the balance microstructure other than ferrite or carbides (hereinafter, also referred to as simply the balance microstructure), the grain diameter of proeutectoid ferrite, and the ratio of the volume of proeutectoid ferrite grains with grain diameters of 3 μm or more. For the hot rolled-annealed sheet, image analysis processing described below was performed on a scanning electron microscope photograph to determine the volume fraction of the balance microstructure, the proeutectoid ferrite fraction (the ratio of the volume of proeutectoid ferrite to the volume of the entire microstructure), and the ratio of the number of carbides with particle diameters of 1 μm or more to the total number of carbides. As each value, the arithmetic average value of values, obtained by performing image analysis processing on scanning electron microscope photographs of different three fields of view, was used.

A scanning electron microscope photograph was subjected to binarization processing for ferrite and carbides, and the balance microstructure by using an image analysis software application, and the ratio of the area of the balance microstructure to the area of the whole was determined as the volume fraction of the balance microstructure other than ferrite or carbides. Further, the value obtained by subtracting the volume fraction (%) of the balance microstructure from 100% was taken as the fraction (%) of the volume of ferrite and carbides to the volume of the entire microstructure.

As the grain diameter of proeutectoid ferrite of the hot rolled steel sheet, a value measured by using a method for estimating the grain size provided by JIS G 0551 (intercept method) was used. The area fraction of proeutectoid ferrite grains having grain diameters of 3 μm or more out of these grains was measured by an image analysis software application, and this measurement value was used as the ratio of the volume of proeutectoid ferrite grains with grain diameters of 3 μm or more to the volume of the entire microstructure.

As the ratio of the volume of proeutectoid ferrite in the entire microstructure in the hot rolled-annealed sheet, a measurement value of the area fraction of proeutectoid ferrite obtained by using an image analysis software application on a scanning electron microscope photograph of the hot rolled-annealed sheet was used.

The ratio of the number of carbides with particle diameters of 1 μm or more to the total number of carbides was obtained by a method in which a scanning electron microscope photograph was subjected to binarization processing for ferrite and carbides by using an image analysis software application, further an image processing software application, Image J, was used to determine the circle-equivalent diameter of each carbide, and the number of carbides with particle diameters of 1 μm or more was divided by the total number of carbides.

Mn Concentration in the Carbides

The hot rolled-annealed sheet was subjected to constant-current electrolysis at a current density of 20 mA/cm$^2$ in a 10-vol % acetylacetone-1-mass % tetramethylammonium chloride-methanol electrolytic solution. Subsequently, the test piece was taken out of the electrolytic solution and was moved to a beaker in which methanol was put, and the precipitates adhered to the surface of the sample were thoroughly removed by ultrasonic stirring and were collected by using a filter with a pore size of 0.2 μm. This extraction residue was subjected to inductively coupled plasma atomic emission spectroscopy, and thereby the concentration (mass %) of Mn contained in the precipitates was determined; the results are shown in Table 2-2.

Cold Workability

In order to evaluate workability, a JIS 13B tensile test piece was taken from the hot rolled-annealed sheet in such a manner that the rolling direction and the tensile direction were parallel; using AG-IS250kN manufactured by Shimadzu Corporation, a tensile test in accordance with JIS Z 2241 (2011) standard was performed at a crosshead speed of 10 mm/min, and the elongation after fracture (%) was obtained; the results are shown in Table 3. In the disclosed embodiments, a sample having an elongation after fracture of 30% or more was assessed as having excellent cold workability.

Hardenability and Surface Layer Hardness after Quenching

The hot rolled-annealed sheet was subjected to shearing work to manufacture a member, and the member was subjected to isothermal holding at 925° C. for 30 min in a salt bath and was then subjected to water cooling. For a cross section in the rolling direction of this test piece, the Vickers hardness distribution in the sheet thickness direction was measured at a load of 1.0 kgf. A sample having a Vickers hardness of HV 430 or more at a position of ¼ of the sheet thickness (¼ t) was assessed as evaluation rank A, and a sample having a Vickers hardness of less than HV 430 was assessed as evaluation rank B. Here, a sample of evaluation rank A was assessed as having excellent hardenability. Further, a sample having a Vickers hardness of HV 450 or more at a position of 0.3 mm in the sheet thickness direction from the surface of the steel sheet was assessed as evaluation rank A, and a sample having a Vickers hardness of less than HV 450 was as evaluation rank B.

Here, a sample of evaluation rank A was assessed as having excellent surface layer hardness after quenching.

TABLE 1

| Steel No. | Chemical composition (mass %) C | Si | Mn | P | S | sol. Al | N | Cr | B | Sb, Sn, Bi, Ge, Te, Se | Ni | Mo | Nb, Ti, V | $Ac_1$ (° C.) | $Ar_1$ (° C.) | Remarks |
|---|---|---|---|---|---|---|---|---|---|---|---|---|---|---|---|---|
| A | 0.25 | 0.15 | 0.63 | 0.014 | 0.0014 | 0.029 | 0.0029 | 0.75 | — | — | — | — | — | 755 | 744 | Conforming steel |
| B | 0.12 | 0.45 | 0.47 | 0.015 | 0.0015 | 0.030 | 0.0031 | 0.99 | 0.0028 | — | — | — | — | 759 | 750 | Conforming steel |
| C | 0.20 | 0.26 | 0.54 | 0.015 | 0.0019 | 0.030 | 0.0028 | 1.00 | 0.0034 | Sb: 0.010 | — | — | — | 750 | 738 | Conforming steel |
| D | 0.20 | 0.26 | 1.11 | 0.016 | 0.0022 | 0.030 | 0.0030 | 1.00 | 0.0029 | Sn: 0.02, Bi: 0.003, Ge: 0.002 | — | — | — | 746 | 735 | Conforming steel |
| E | 0.20 | 0.01 | 0.77 | 0.017 | 0.0020 | 0.036 | 0.0033 | 0.51 | 0.0024 | Te: 0.01, Se: 0.01 | — | — | — | 737 | 728 | Conforming steel |
| F | 0.20 | 0.01 | 0.75 | 0.016 | 0.0020 | 0.035 | 0.0029 | 0.86 | 0.0023 | — | 0.20 | — | — | 744 | 733 | Conforming steel |
| G | 0.28 | 0.01 | 0.75 | 0.015 | 0.0020 | 0.033 | 0.0030 | 1.00 | 0.0027 | — | — | 0.22 | — | 736 | 726 | Conforming steel |
| H | 0.20 | 0.01 | 0.74 | 0.015 | 0.0020 | 0.031 | 0.0029 | 0.52 | 0.0009 | — | — | — | Ti: 0.015 | 734 | 723 | Conforming steel |
| I | 0.19 | 0.01 | 0.50 | 0.015 | 0.0021 | 0.034 | 0.0030 | 1.25 | 0.0049 | — | — | — | Nb: 0.01, V: 0.015 | 749 | 738 | Conforming steel |
| J | 0.36 | 0.01 | 0.75 | 0.016 | 0.0019 | 0.034 | 0.0031 | 1.00 | 0.0030 | — | — | — | — | 732 | 722 | Steel of Comparative example |
| K | 0.20 | 0.26 | 0.37 | 0.015 | 0.0017 | 0.030 | 0.0026 | 1.00 | 0.0033 | — | — | — | — | 754 | 742 | Steel of Comparative example |
| L | 0.20 | 0.01 | 1.53 | 0.014 | 0.0022 | 0.031 | 0.0024 | 1.01 | 0.0028 | — | — | — | — | 747 | 737 | Steel of Comparative example |
| M | 0.20 | 0.01 | 0.76 | 0.016 | 0.0018 | 0.036 | 0.0032 | 0.25 | 0.0023 | — | — | — | — | 728 | 718 | Steel of Comparative example |
| N | 0.20 | 0.01 | 0.75 | 0.016 | 0.0024 | 0.032 | 0.0028 | 1.98 | 0.0030 | — | — | — | — | 754 | 743 | Steel of Comparative example |

TABLE 2-1

| No. | Steel No. | Hot rolling condition: Finishing temperature (° C.) | *1 (° C./s) | Coiling temperature (° C.) | *2 (%) | Annealing condition Temperature•time | Remarks |
|---|---|---|---|---|---|---|---|
| 1 | A | 901 | 37 | 593 | 30 | 715° C.•20 hr | Example |
| 2 | A | 926 | 33 | 581 | 13 | 715° C.•20 hr | Comparative Example |
| 3 | B | 913 | 32 | 594 | 31 | 715° C.•20 hr | Example |
| 4 | B | 912 | 52 | 588 | 26 | 715° C.•20 hr | Comparative Example |
| 5 | C | 911 | 35 | 610 | 29 | 715° C.•20 hr | Example |
| 6 | C | 916 | 38 | 521 | 15 | 715° C.•20 hr | Comparative Example |
| 7 | D | 915 | 34 | 641 | 33 | 715° C.•20 hr | Example |
| 8 | D | 918 | 44 | 641 | 24 | 750° C.•20 hr | Comparative Example |
| 9 | E | 915 | 37 | 670 | 26 | 750° C.•1 hr → 715° C.•20 hr | Example |
| 10 | E | 916 | 34 | 611 | 33 | 810° C.•1 hr → 715° C.•20 hr | Comparative Example |
| 11 | F | 913 | 40 | 651 | 30 | 715° C.•20 hr | Example |
| 12 | G | 916 | 34 | 672 | 30 | 715° C.•20 hr | Example |
| 13 | H | 913 | 35 | 620 | 29 | 715° C.•20 hr | Example |
| 14 | I | 898 | 36 | 641 | 21 | 715° C.•20 hr | Example |
| 15 | J | 918 | 36 | 639 | 33 | 715° C.•20 hr | Comparative Example |
| 16 | K | 915 | 34 | 644 | 25 | 715° C.•20 hr | Comparative Example |
| 17 | L | 916 | 38 | 628 | 37 | 715° C.•20 hr | Comparative Example |
| 18 | M | 913 | 38 | 688 | 26 | 715° C.•20 hr | Comparative Example |
| 19 | N | 916 | 36 | 610 | 30 | 715° C.•20 hr | Comparative Example |
| 20 | A | 908 | 42 | 602 | 35 | 760° C.•1 hr → 715° C.•25 hr | Example |
| 21 | B | 901 | 38 | 612 | 77 | 800° C.•0.5 hr → 715° C.•20 hr | Example |
| 22 | C | 880 | 34 | 590 | 58 | 700° C.•35 hr | Example |
| 23 | D | 820 | 15 | 710 | 82 | 715° C.•20 hr | Comparative Example |
| 24 | E | 890 | 35 | 593 | 33 | 750° C.•1 hr → 725° C.•20 hr | Example |
| 25 | F | 894 | 29 | 599 | 38 | 750° C.•1 hr → 725° C.•20 hr | Example |
| 26 | G | 912 | 40 | 602 | 32 | 770° C.•0.5 hr → 740° C.•20 hr | Comparative Example |

*1 Average cooling rare from the finishing temperature to 700° C. (Note that No. 23 is an average cooling rate from the finishing temperature to the coiling temperature)
*2 Ratio of the volume of proeutectoid ferrite grains with grain diameters of 3 μm or more to the volume of the entire microstructure after being hot rolled

TABLE 2-2

| No. | Steel No. | *1 (%) | *2 (%) | *3 (mass %) | *4 (%) | Remarks |
|---|---|---|---|---|---|---|
| 1 | A | 97 | 30 | 0.17 | 34 | Example |
| 2 | A | 97 | 15 | 0.16 | 40 | Comparative Example |
| 3 | B | 93 | 31 | 0.13 | 32 | Example |
| 4 | B | 100 | 27 | 0.06 | 28 | Comparative Example |
| 5 | C | 99 | 29 | 0.14 | 35 | Example |
| 6 | C | 98 | 17 | 0.14 | 36 | Comparative Example |
| 7 | D | 97 | 33 | 0.48 | 32 | Example |
| 8 | D | 88 | 25 | 0.21 | 42 | Comparative Example |
| 9 | E | 97 | 26 | 0.20 | 40 | Example |
| 10 | E | 86 | 34 | 0.22 | 43 | Comparative Example |
| 11 | F | 97 | 30 | 0.20 | 36 | Example |
| 12 | G | 97 | 31 | 0.19 | 35 | Example |
| 13 | H | 99 | 29 | 0.23 | 36 | Example |
| 14 | I | 99 | 22 | 0.28 | 33 | Example |
| 15 | J | 97 | 34 | 0.20 | 35 | Comparative Example |
| 16 | K | 98 | 25 | 0.07 | 28 | Comparative Example |
| 17 | L | 100 | 39 | 0.58 | 35 | Comparative Example |
| 18 | M | 96 | 27 | 0.24 | 33 | Comparative Example |
| 19 | N | 97 | 30 | 0.23 | 38 | Comparative Example |
| 20 | A | 90 | 37 | 0.27 | 39 | Example |
| 21 | B | 93 | 78 | 0.21 | 35 | Example |
| 22 | C | 94 | 59 | 0.19 | 42 | Example |
| 23 | D | 95 | 82 | 0.26 | 45 | Comparative Example |
| 24 | E | 97 | 35 | 0.30 | 57 | Example |

TABLE 2-2-continued

| No. | Steel No. | *1 (%) | *2 (%) | *3 (mass %) | *4 (%) | Remarks |
|---|---|---|---|---|---|---|
| 25 | F | 95 | 39 | 0.22 | 49 | Example |
| 26 | G | 35 | 33 | 0.24 | 63 | Comparative Example |

*1 Ratio of the volume of ferrite and carbides to the volume of the entire microstructure
*2 Ratio of the volume of proeutectoid ferrite to the volume of the entire microstructure (proeutectoid ferrite fraction)
*3 Mn concentration in the carbides
*4 Ratio of the number of carbides with particle diameters of 1 μm or more to the total number of carbides

TABLE 3

| No. | Cold workability Elongation after fracture (%) | Hardenability | Post-quenching surface layer hardness (HV) | Remarks |
|---|---|---|---|---|
| 1 | 32 | A | A | Example |
| 2 | 28 | A | A | Comparative Example |
| 3 | 36 | A | A | Example |
| 4 | 35 | A | B | Comparative Example |
| 5 | 36 | A | A | Example |
| 6 | 27 | A | A | Comparative Example |
| 7 | 35 | A | A | Example |
| 8 | 25 | A | A | Comparative Example |
| 9 | 34 | A | A | Example |
| 10 | 28 | A | A | Comparative Example |

TABLE 3-continued

| No. | Cold workability Elongation after fracture (%) | Hardenability | Post-quenching surface layer hardness (HV) | Remarks |
|---|---|---|---|---|
| 11 | 35 | A | A | Example |
| 12 | 32 | A | A | Example |
| 13 | 36 | A | A | Example |
| 14 | 37 | A | A | Example |
| 15 | 27 | A | A | Comparative Example |
| 16 | 37 | B | B | Comparative Example |
| 17 | 27 | A | A | Comparative Example |
| 18 | 37 | B | B | Comparative Example |
| 19 | 25 | A | A | Comparative Example |
| 20 | 31 | A | A | Example |
| 21 | 35 | A | A | Example |
| 22 | 32 | A | A | Example |
| 23 | 36 | A | B | Comparative Example |
| 24 | 33 | A | A | Example |
| 25 | 34 | A | A | Example |
| 26 | 26 | B | B | Comparative Example |

As shown in Table 3, each of Nos. 1, 3, 5, 7, 9, 11 to 14, 20 to 22, 24, and 25 of the Examples has shown excellent cold workability, hardenability, and surface layer hardness after quenching.

In contrast, No. 2 of Comparative Example had a small proeutectoid ferrite fraction because of a high finish rolling temperature, and was poor in cold workability.

No. 4 of Comparative Example had an insufficient Mn concentration in the carbides and an insufficient ratio of carbides with particle diameters of 1 μm or more because of a high cooling rate, and was poor in surface layer hardness after quenching.

No. 6 of Comparative Example had a small proeutectoid ferrite fraction because of a low coiling temperature, and was poor in cold workability.

Each of Nos. 8 and 10 of Comparative Examples experienced formation of a large amount of pearlite because of a high annealing temperature, and was poor in cold workability.

Each of Nos. 15 to 19 of Comparative Examples was poor in one of cold workability, hardenability, and surface layer hardness after quenching because the concentration of one of C, Mn, and Cr was inappropriate.

No. 23 of Comparative Example had an excessively large proeutectoid ferrite fraction because of a high coiling temperature, and was poor in surface layer hardness after quenching.

No. 26 of Comparative Example experienced formation of a large amount of pearlite and furthermore an excessive increase in the number of carbides with particle diameters of 1 μm or more because the annealing temperature was the $Ar_1$ transformation temperature or more, and was poor in cold workability, hardenability, and surface layer hardness after quenching.

The invention claimed is:

1. A steel sheet having a chemical composition comprising, by mass %:

C: 0.10% or more and 0.33% or less;

Si: 0.01% or more and 0.50% or less;

Mn: 0.40% or more and 1.25% or less;

P: 0.03% or less;

S: 0.01% or less;

sol. Al: 0.10% or less;

N: 0.01% or less;

Cr: 0.50% or more and 1.50% or less; and a balance being Fe and incidental impurities, wherein the steel sheet has a microstructure containing ferrite and carbides, a ratio of a volume of the ferrite and the carbides to a volume of an entire microstructure is 90% or more, and a ratio of a volume of proeutectoid ferrite to the volume of the entire microstructure is in a range of 20% or more and 80% or less, a Mn concentration in the carbides is in a range of 0.10 mass % or more and 0.50 mass % or less, and a ratio of a number of carbides with particle diameters of 1 μm or more to a total number of carbides is in a range of 30% or more and 60% or less.

2. The steel sheet according to claim 1, wherein the chemical composition further comprises, by mass %, at least one Group selected from the groups consisting of:

Group A: B: 0% or more and 0.01% or less,

Group B: at least one selected from the group consisting of Sb, Sn, Bi, Ge, Te, and Se: 0.002% or more and 0.03% or less in total, Group C: at least one of Ni and Mo: 0.01% or more and 0.5% or less in total, and Group D: at least one selected from the group consisting of Nb, Ti, and V: 0.001% or more and 0.05% or less in total.

3. A method for manufacturing a steel sheet according to claim 1, the method comprising:

performing rough hot rolling on a steel raw material having the chemical composition, subsequently performing finish rolling at a finishing temperature of 920° C. or less, and performing cooling such that an average cooling rate from the finishing temperature to 700° C. is 50° C./s or less, subsequently performing coiling at a coiling temperature in a range of 550° C. or more and 700° C. or less and causing a ratio of a volume of proeutectoid ferrite grains with grain diameters of 3 μm or more to a volume of an entire microstructure to be in a range of 20% or more and 80% or less, and subsequently performing annealing at an annealing temperature in a range of 700° C. or more and less than an $Ac_1$ transformation temperature.

4. A method for manufacturing a steel sheet according to claim 1, the method comprising:

performing rough hot rolling on a steel raw material having the chemical composition, subsequently performing finish rolling at a finishing temperature of 920° C. or less, and performing cooling such that an average cooling rate from the finishing temperature to 700° C. is 50° C./s or less, subsequently performing coiling at a coiling temperature in a range of 550° C. or more and 700° C. or less and causing a ratio of a volume of proeutectoid ferrite grains with grain diameters of 3 μm or more to a volume of an entire microstructure to be in a range of 20% or more and 80% or less, and subsequently performing annealing by performing heating to a temperature in a range of an $Ac_1$ transformation temperature or more and 800° C. or less, performing holding for 0.5 hours or more, subsequently performing cooling to less than an $Ar_1$ transformation temperature, and performing holding at a temperature in a range of 700° C. or more and less than the $Ar_1$ transformation temperature for 20 hours or more.

5. A member obtained by performing at least one of forming and heat treatment on the steel sheet according to claim 1.

6. A method for manufacturing a member, the method comprising a step of performing at least one of forming and heat treatment on a steel sheet manufactured by the method for manufacturing a steel sheet according to claim 3.

7. A method for manufacturing a steel sheet according to claim 2, the method comprising:

performing rough hot rolling on a steel raw material having the chemical composition, subsequently performing finish rolling at a finishing temperature of 920° C. or less, and performing cooling such that an average cooling rate from the finishing temperature to 700° C. is 50° C./s or less, subsequently performing coiling at a coiling temperature in a range of 550° C. or more and 700° C. or less and causing a ratio of a volume of proeutectoid ferrite grains with grain diameters of 3 μm or more to a volume of an entire microstructure to be in a range of 20% or more and 80% or less, and subsequently performing annealing at an annealing temperature in a range of 700° C. or more and less than an $Ac_1$ transformation temperature.

8. A method for manufacturing a steel sheet according to claim 2, the method comprising:

performing rough hot rolling on a steel raw material having the chemical composition, subsequently performing finish rolling at a finishing temperature of 920° C. or less, and performing cooling such that an average cooling rate from the finishing temperature to 700° C. is 50° C./s or less, subsequently performing coiling at a coiling temperature in a range of 550° C. or more and 700° C. or less and causing a ratio of a volume of proeutectoid ferrite grains with grain diameters of 3 μm or more to a volume of an entire microstructure to be in a range of 20% or more and 80% or less, and subsequently performing annealing by performing heating to a temperature in a range of an $Ac_1$ transformation temperature or more and 800° C. or less, performing holding for 0.5 hours or more, subsequently performing cooling to less than an $Ar_1$ transformation temperature, and performing holding at a temperature in a range of 700° C. or more and less than the $Ar_1$ transformation temperature for 20 hours or more.

9. A member obtained by performing at least one of forming and heat treatment on the steel sheet according to claim 2.

10. A method for manufacturing a member, the method comprising a step of performing at least one of forming and heat treatment on a steel sheet manufactured by the method for manufacturing a steel sheet according to claim 4.

11. A method for manufacturing a member, the method comprising a step of performing at least one of forming and heat treatment on a steel sheet manufactured by the method for manufacturing a steel sheet according to claim 7.

12. A method for manufacturing a member, the method comprising a step of performing at least one of forming and heat treatment on a steel sheet manufactured by the method for manufacturing a steel sheet according to claim 8.

* * * * *